United States Patent [19]

Walling et al.

[11] 4,201,250

[45] May 6, 1980

[54] POWDER DISTRIBUTOR FOR FILLING A CABLE

[75] Inventors: Jörg-Hein Walling, St. Hubert; Jean Bouffard, Lachine, both of Canada

[73] Assignee: Northern Telecom Limited, Montreal, Canada

[21] Appl. No.: 876,873

[22] Filed: Feb. 13, 1978

[51] Int. Cl.[2] ..... H01B 19/00

[52] U.S. Cl. ..... 141/250; 198/642; 174/23 C

[58] Field of Search ..... 141/250, 290; 174/23 R, 174/23 C, 102 P, 118; 156/48; 57/8, 7; 222/413, 252, 410, 202, 195; 366/155, 156, 325; 198/642, 638

[56] References Cited

U.S. PATENT DOCUMENTS

| | | | |
|---|---|---|---|
| 1,267,681 | 5/1918 | Martin | 198/642 |
| 1,405,731 | 2/1922 | Macnicol | 198/642 X |
| 2,427,507 | 9/1947 | Powell et al. | 57/7 |
| 2,512,955 | 6/1950 | Martin | 198/642 |
| 2,672,347 | 3/1954 | Rausch | 198/642 X |
| 3,538,235 | 11/1970 | Arendt et al. | 174/23 C |

*Primary Examiner*—Willis Little

[57] ABSTRACT

A device for filling the interstices of multi-stranded cable with powder, comprising an outer cylindrical housing and a concentric inner tube with an annular chamber between them. The tube at one end carries a coaxial impeller located at the outlet end portion of the housing. Powder is fed into the chamber and a helical screw pushes the powder onto the impeller which is rotated to distribute the powder onto conductors passing from a strander around the device and into a closing die.

7 Claims, 4 Drawing Figures

POWDER DISTRIBUTOR FOR FILLING A CABLE

This invention relates to the production of multi-stranded electrical cables and more particularly to filling the interstices in such cables with powder.

Multi-stranded electrical cables are filled with powder for water blockage. A powder filling for this purpose is described in U.S. Pat. No. 4,002,819 issued Jan. 11, 1977 to Northern Telecom Limited assignee of Leo. V. Woytiuk. One method of filling the interstices of the cable is by passing the cable core through an electrostatic powder chamber as described in U.S. patent application Ser. No. 564,070 filed Apr. 1, 1975 in the name of Leo. V. Woytiuk assignor to Northern Telecom Limited. Such a method is relatively difficult to operate to obtain fine adjustments in the amount of powder filling placed within the interstices of the cable, i.e. the percentage of voids filled by the powder.

It is an object of the present invention to provide an improved method and apparatus for powder filling a multi-stranded cable.

Essentially the invention consists of a device for filling the interstices of a multi-stranded electric cable with power in which a plurality of strands are fed into a closing die having an outwardly flaring inlet wall, a device comprising: a cylindrical housing; a tube concentric with the housing and spaced inwardly therefrom to form with the housing an annular chamber having an outlet end, and an aperture opening into the chamber for feeding powder thereto; a helical screw concentrically mounted within the chamber and means to rotate the screw oxially whereby powder is moved along the chamber from the aperture to the outlet end thereof; and a drive shaft passing axially through the tube and having an impeller coaxially mounted at the end thereof, the impeller being located at the outlet end of the chamber, and means to rotate the drive shaft axially and independently of movement of the screw whereby powder moved along the chamber is dispersed laterally from the outlet end thereof, the outlet end of the chamber being locatable within the inlet wall of the closing die and spaced therefrom.

Example embodiments of the invention are shown in the accompanying drawings in which.

Figure 1:
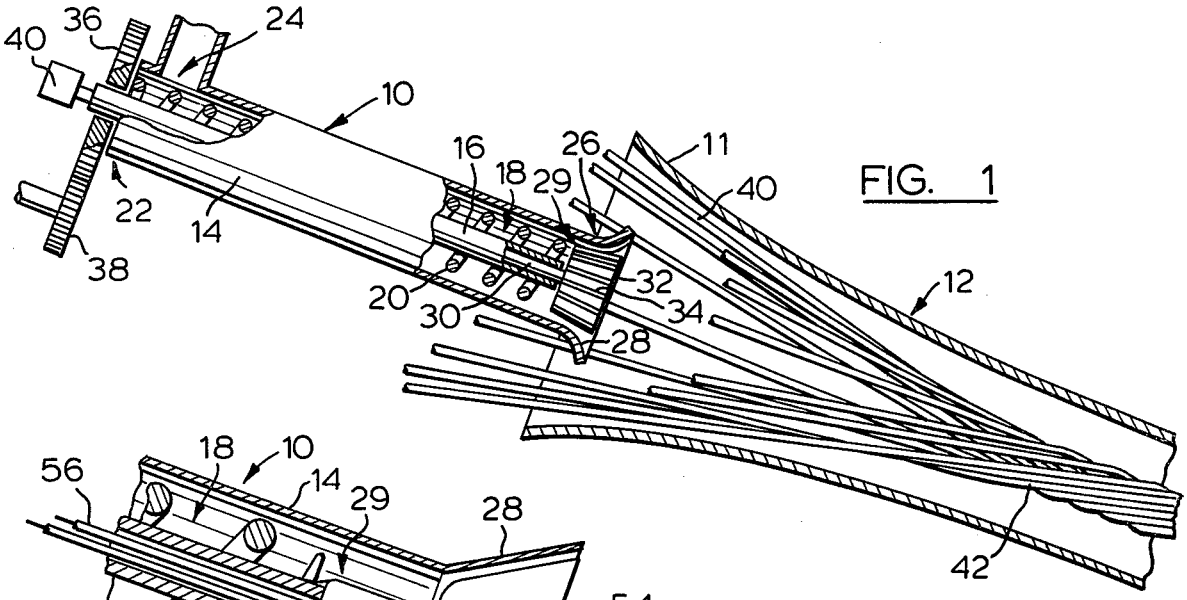
FIG. 1 is a side view in cross-section of a device for powder filling a cable.

The example embodiment shown in FIG. 1 of the drawings consists of a cable filling device in the form of a powder distributor 10 located at the inlet wall 11 of a closing die 12. Distributor 10 comprises an outer housing 14 and an inner tube 16 fixed to the outer housing, the tube and housing forming between them an annular chamber 18. A rotatable helical screw member 20 concentric with tube 16 is located in chamber 18. That end of chamber 18 and housing 14 remote from closing die 12, designated the inlet end 22, has a powder feed aperture 24 opening laterally into the chamber. Outlet end 26 of housing 14, which in the operation of the device is located within inlet end 11 of closing die 12, flares outwardly to form a bell mouth 28. A drive shaft 30 extends coaxially through tube 16 which terminates short of outlet end 26 of outer tube 14 and defines an outlet 29 of chamber 18. Drive shaft 30 projects from tube 16 and carries an impeller 32 located in bell mouth 28 of housing 14. Impeller 32 is frustroconical with spaced ribs or blades 34 on its outer surface. Helical screw 20 terminates an outlet 29 of chamber 18 short of impeller 32. Adjacent inlet end 22 of distributor 10 lies a gear 36 coaxial with housing 14 and meshing with a drive gear 38. Helical screw 20 is fixed at one end to gear 36. In this embodiment gear 36 serves to close inlet end 22 of housing 14 and chamber 18. Fixed tube 16 and drive shaft 30 extend through gear 26, drive shaft 30 being driven by suitable drive means 40.

In the operation of the device of FIG. 1 conductors 40 are fed from a strander (not shown) into closing die 12 through its inlet wall 11 to form a stranded cable 42. Distributor 10 is located within the circle of conductors as they enter the closing die and is coaxially aligned with the closing die. As conductors 40 are fed into closing die 12, powder is fed continuously through powder feed aperture 24 into chamber 18 and gear 36 is rotated by drive gear 38 which rotates helical screw 20. Screw 20 carries the powder forward in chamber 18 to impeller 32. Impeller 32, rotated by drive shaft 30, throws the powder out laterally into closing die 12 around conductors 40 and as the conductors close to form cable 42 the powder is carried by the conductors to fill the intersticies in the cable. Preferably conductors 40 are coated with oil to which the powder adheres.

Figure 2:
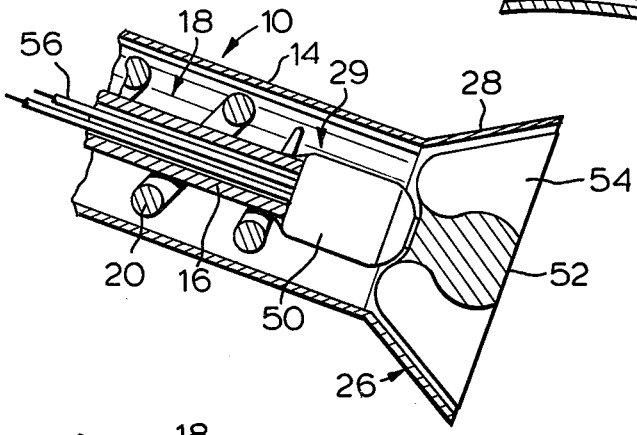
FIG. 2 is a cross-sectional side view of an alternate embodiment of the device of FIG. 1.

The device shown in FIG. 2 is an alternate embodiment of the device of FIG. 1 and it is employed in the same manner to powder fill a stranded cable. In this alternate embodiment tube 16 terminates in an electric motor 50 which drives an impeller 52 located coaxially in bell mouth 28 of housing 14 and having spaced blades 54. Gear 36 is driven as before but tube 16 carries electrical leads 56 for motor 50. The operation of this alternate embodiment is the same device of FIG. 1.

Figure 3:
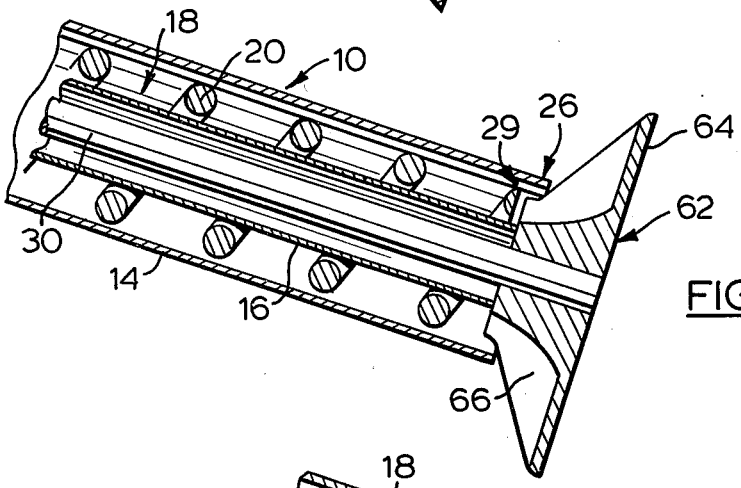
FIG. 3 is a cross-sectional side view of another alternate embodiment of the device of FIG. 1.

In FIG. 3 distributor 10 is modified to provide another form of impeller driven by shaft 30 as seen in FIG. 1. In this embodiment outlet end 26 of housing 14 is not flared and drive shaft 30 terminates in an impeller 62 which extends outwardly and laterally beyond the outlet end of the outer tube, the turbine being annularly dished with a deflector plate 64 normal to the axis of the drive shaft and with spaced blades 66.

In the operation of the embodiment of FIG. 3 powder is moved by helical screw 20 along chamber 18 and delivered to impeller 62 which throws it laterally outwardly against conductors 40 within closing die 12.

Figure 4:
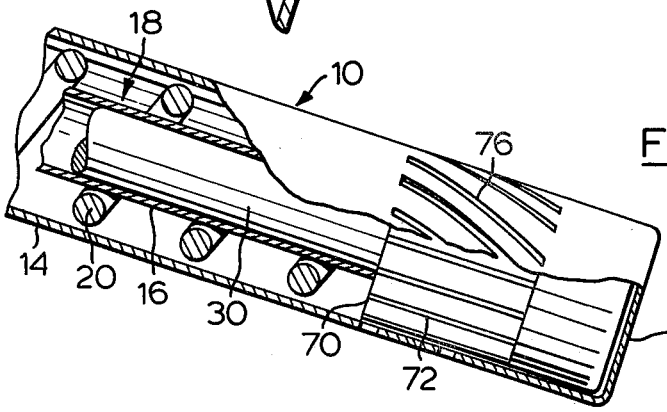
FIG. 4 is a cross-sectional side view of yet another alternate embodiment of the device of FIG. 1.

The example embodiment of FIG. 4 shows an impeller 70 enclosed by housing 14. Impeller 70 is cylindrical and mounted on the end of drive shaft 30 as before, with spaced blades 72. Housing 14 has a closed outlet end 74 with a ring of spaced slots 76 opening laterally from the housing in the region of blades 72 of impeller 70. Slots 76 are curved in the direction of rotation of impeller 70 for increased flow of powder.

In the operation of the device of FIG. 4 helical screw 20 feeds powder to impeller 72 which throws the powder laterally through slots 76 and against conductors 40 in closing die 40.

It will be appreciated that the shape and orientation of the blades on the impeller of the device are alterable to achieve the purpose of the distributor.

The centrifugal force applied to the powder by the impeller distributes the powder effectively to the conductors and this is especially important where the conductors are oil-coated or the powder particles are to adhere to the conductors electrostatically. Also the force imparted to the powder particles inhibits them from agglomerating. The powder is distributed symmetrically to the conductors and excess powder may be collected at the outlet of the closing die for recycling.

It will also be appreciated that types of mechanism may be employed for driving impeller 42 other than meshing gears 26 and 28; for example a worm and screw, a belt and pulley, or a chain and sprocket.

We claim:

1. A device for filling the interstices of a multistranded electric cable with powder in which a plurality of strands are fed into a closing die having an outwardly flaring inlet wall, a device comprising:

a cylindrical housing;

a tube concentric with the housing and spaced inwardly therefrom to form with the housing an annular chamber having an outlet end, and an aperture opening into the chamber for feeding powder thereto;

a helical screw concentrically mounted within the chamber and means to rotate the screw oxially whereby powder is moved along the chamber from the aperture to the outlet end thereof; and a drive shaft passing axially through the tube and having an impeller coaxially mounted at the end thereof, the impeller being located at the outlet end of the chamber, and means to rotate the drive shaft axially and independently of movement of the screw whereby powder moved along the chamber is dispersed laterally from the outlet end thereof, the outlet end of the chamber being locatable within the inlet wall of the closing die and spaced therefrom.

2. A device as claimed in claim 1 in which the impeller includes an electric motor mounted on the end of the tube, the electrical leads for the motor passing through the tube.

3. A device as claimed in claim 1 in which the impeller comprises a frustro-conical member having a plurality of spaced blades extending laterally therefrom.

4. A device as claimed in claim 1 in which the impeller comprises a frustro-conical member having a plurality of spaced blades extending laterally therefrom and a deflector plate normal to the axis thereof.

5. A device as claimed in claim 1 in which the housing is closed about the impeller and has a circumscribing ring of lateral spaced slots opening therethrough adjacent the impeller.

6. A device as claimed in claim 5 in which the means to rotate the screw comprises a gear fixed coaxially to the screw and closing that end of the chamber remote from the outlet end.

7. A device as claimed in claim 6 in which the impeller is mounted on the end of said drive shaft which passes axially through the tube the drive shaft the gear, and drive means being fixed to that end of the drive shaft remote from the impeller.

* * * * *